US007511429B2

(12) United States Patent
Anami et al.

(10) Patent No.: US 7,511,429 B2
(45) Date of Patent: Mar. 31, 2009

(54) HIGH INTENSITY DISCHARGE LAMP HAVING AN IMPROVED ELECTRODE ARRANGEMENT

(75) Inventors: Shinichi Anami, Wellesley, MA (US); Huiling Zhu, Lexington, MA (US)

(73) Assignees: Panasonic Corporation, Osaka (JP); Panasonic Electric Works, Ltd, Osaka (JP)

( * ) Notice: Subject to any disclaimer, the term of this patent is extended or adjusted under 35 U.S.C. 154(b) by 445 days.

(21) Appl. No.: 11/354,759

(22) Filed: Feb. 15, 2006

(65) Prior Publication Data

US 2007/0188100 A1 Aug. 16, 2007

(51) Int. Cl.
*H01J 17/18* (2006.01)
*H01J 61/36* (2006.01)

(52) U.S. Cl. ..... 313/623; 313/332; 313/626

(58) Field of Classification Search ..... 313/623, 313/491, 574, 625, 626, 631, 332
See application file for complete search history.

(56) References Cited

U.S. PATENT DOCUMENTS 5,455,480 A 10/1995 Bastian et al.
6,075,314 A * 6/2000 Huettinger et al. ..... 313/332
6,181,065 B1 1/2001 Huettinger et al.
6,392,345 B1 5/2002 Niimi et al.
6,414,451 B1 7/2002 Baake et al.
6,495,959 B1 12/2002 Ikeuchi et al.
6,495,960 B1 12/2002 Takeji et al.
2005/0093453 A1* 5/2005 Niimi ..... 313/604
2006/0170358 A1* 8/2006 Selverian ..... 313/623

* cited by examiner

*Primary Examiner*—Ashok Patel
(74) *Attorney, Agent, or Firm*—Harness, Dickey & Pierce, PLC

(57) ABSTRACT

An arc tube is provided for use in a high intensity discharge lamp. The arc tube is generally comprised of an elongated outer envelope defining two opposed ends and a cavity therebetween; an electrode sleeve protruding outwardly from each end of the outer envelope, such that each electrode sleeve has a passageway; and an electrical feedthrough member inserted into the passageway of the electrode sleeve, where the feedthrough member includes an inner rod that extends into the cavity of the arc tube and a ceramic sleeve encircling a portion of the inner rod disposed within the passageway. A sealing compound is disposed at an outwardly facing end of the passageway for sealing the feedthrough member to the electrode sleeve, such that the sealing compound extends into the passageway of the electrode sleeve but is spatially separated from the ceramic sleeve.

14 Claims, 2 Drawing Sheets

HIGH INTENSITY DISCHARGE LAMP HAVING AN IMPROVED ELECTRODE ARRANGEMENT

FIELD

Figure 1:
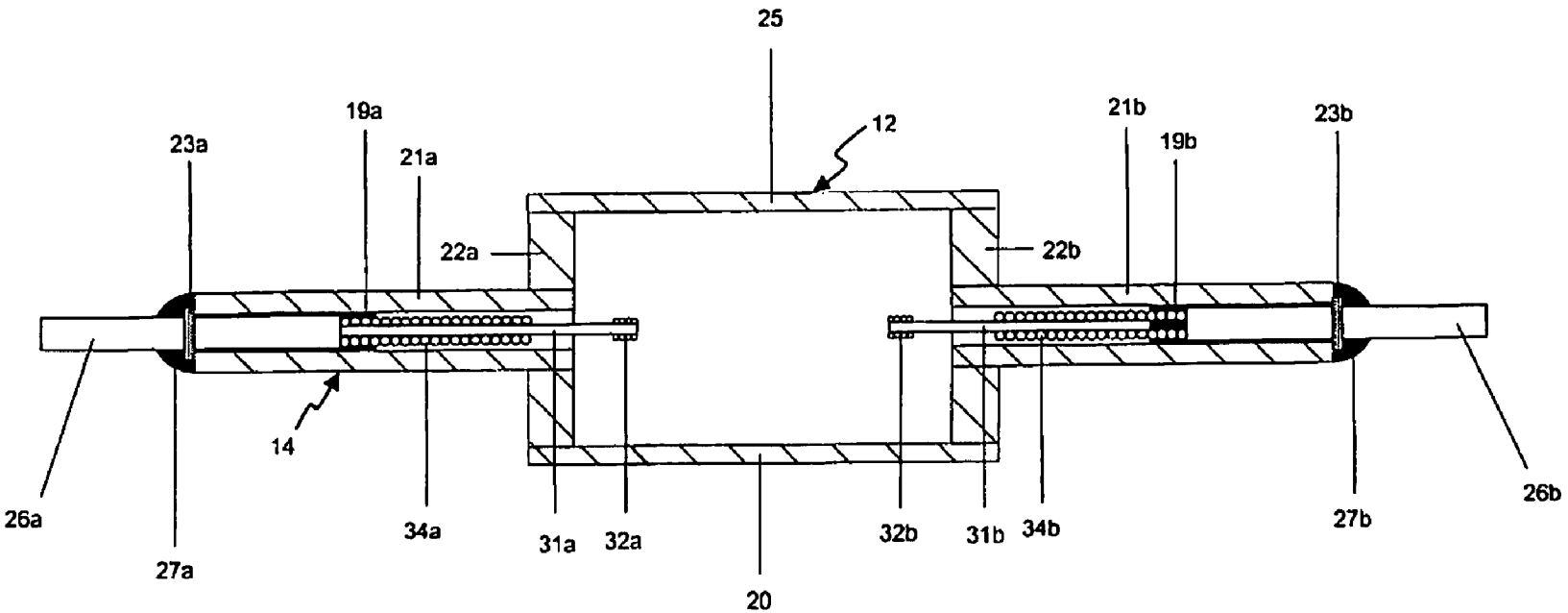
FIG. 1 PRIOR ART

The present disclosure relates to high intensity discharge lamps and, more particularly, to an improved electrode arrangement for the arc tube of the lamp.

BACKGROUND

In a conventional construction of a high intensity discharge lamp, the electrode arrangement is hermetically sealed to the polycrystalline alumina arc tube by a glass frit with specific composition to match the thermal expansion coefficient of the polycrystalline alumina arc tube. In making the electrode, materials such as niobium metal, molybdenum-alumina cermet, or tungsten-alumina cermet are used since their thermal expansion coefficients are close to that of the polycrystalline alumina. Even with the careful design of the sealing frit material, cracking failure in the sealing area during lamp manufacture and lamp life cannot be completely prevented due to the construction of the electrode. In most electrode designs, there is molybdenum coil encircling either a molybdenum rod or a tungsten rod disposed between the frit sealing area and the tungsten electrode tip. When the frit over flows onto this middle portion of the electrode during the sealing process, there is a possibility of cracking in the sealing area during the sealing process or during lamp life.

Furthermore, due to the difference of thermal expansion coefficient between polycrystalline alumna and molybdenum, a relatively larger gap exists between the inner diameter of the polycrystalline alumna capillary tube and the molybdenum coil. This gap plus the void space between the molybdenum coil turns require that more metal halide chemical fill amount be filled into the arc tube during arc tube manufacturing. Higher amounts of metal halide chemical fill will introduce more impurity into the arc tube causing starting problems and increasing the rate of chemical reaction with polycrystalline alumina material. In order to reliably prevent cracks due to thermal expansion coefficient mismatch in the sealing region, reduce metal halide fill amount and improve lamp performance, an improved electrode arrangement is proposed.

The statements in this section merely provide background information related to the present disclosure and may not constitute prior art.

SUMMARY

An arc tube is provided for use in a high intensity discharge lamp. The arc tube is generally comprised of an elongated outer envelope defining two opposed ends and a cavity there between; an electrode sleeve protruding outwardly from each end of the outer envelope, such that each electrode sleeve has a passageway; and an electrical feedthrough member inserted into the passageway of the electrode sleeve, where the feedthrough member includes an inner rod that extends into the cavity of the arc tube and a ceramic sleeve encircling a portion of the inner rod disposed within the passageway. A sealing compound is disposed at an outwardly facing end of the passageway for sealing the feedthrough member to the electrode sleeve, such that the sealing compound extends into the passageway of the electrode sleeve but is spatially separated from the ceramic sleeve.

Further areas of applicability will become apparent from the description provided herein. It should be understood that the description and specific examples are intended for purposes of illustration only and are not intended to limit the scope of the present disclosure.

DRAWINGS

Figure 2:
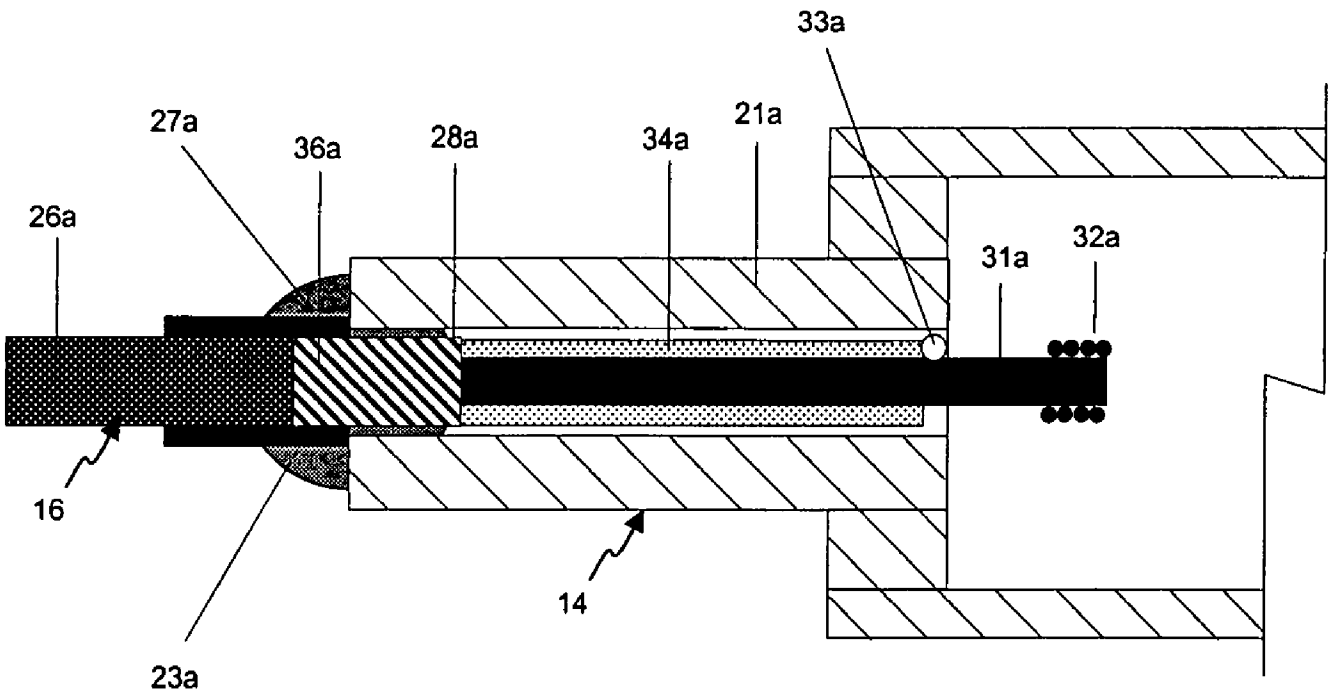

FIG. 1 illustrates an exemplary construction for an arc tube which may be used in a high intensity discharge lamp; and FIG. 2 illustrates an exemplary embodiment of an electrode arrangement for an arc tube according to the present disclosure.

The drawings described herein are for illustration purposes only and are not intended to limit the scope of the present disclosure in any way.

DETAILED DESCRIPTION

FIG. 1 illustrates an exemplary construction for an arc tube 10 which may be used in a high intensity discharge lamp. The arc tube 10 is comprised generally of an elongated outer envelope 12, an electrode sleeve 14 protruding outwardly from each end of the outer envelope 12, and an electrode feedthrough member 16. The outer envelope 12 defines an enclosed discharge space which contains ionizable materials, such as metal halides and mercury, which emit light during lamp operation and a starting gas, such as argon or xenon. It is understood that other materials may be sealed in the arc tube.

In an exemplary embodiment, the outer envelope may be in the form of an open-ended cylinder 25 and a pair of closing disks 22A, 22B joined at each end of the cylinder. Cylindrical electrode sleeves 21A, 21B are inserted into a centered through hole provided by the closing disks 22A, 22B. Thus, the electrode sleeves 21A, 21B protrude outwardly (i.e., longitudinally) from each end of the outer envelope. Each electrode sleeve 21A, 21B further provides a bore along its longitudinal axis, thereby providing a passageway from outside into the inner cavity of the arc tube. These various components of the outer envelope are formed by compacting alumina powder into the desired shape followed by sintering the resulting compact to provide the preformed portion. The preformed portions are then joined by sintering to create a single body of desired dimensions. It is envisioned that other shapes for the outer envelope as well as different types of constructions are also within the scope of this disclosure.

The electrical feedthrough member 16 (also referred to as an electrode) is inserted into the passageway of each electrode sleeve. In a conventional construction, the electrode 16 may be comprised of an outer niobium rod 26A, 26B butt welded to an inner tungsten rod 31A, 31B. The outer rod 26A extends from outside of the electrode sleeve 14 into the passageway of the electrode sleeve. The inner rod 31A, 31B in turn extends from inside the passageway into the inner cavity of the arc tube. A molybdenum coil 34A, 34B may be wound around a portion of the inner rod 31A, 31B disposed within the passageway. In addition, electrode coils 32A, 32B are mounted on the end of the inner rod 31A, 31B residing the cavity of the arc tube. Lastly, a sealing frit 27A, 27B is used to join the electrode 16 to the electrode sleeve 14, thereby enclosing the discharge space of the arc tube. It is noteworthy that the sealing frit extends into the passageway of the electrode sleeve to cover several turns of the molybdenum coil to prevent the outer rod 26A, 26B from contacting with metal halide fills.

If the niobium could have some other material substituted therefore at the seal location, the electrode fabrication and the subsequent sealing process used therewith can be simplified and made more resistant to halide based chemical corrosion during operation as well. Ceramic sealing frits of mixed metal oxides are more halide resistant than the ones used in high pressure sodium lamps in effecting the seals between the polycrystalline alumina of the corresponding electrode tube and the corresponding niobium rod. However, while resistant, this sealing frit is not impervious to chemical attacks. Thus, elimination of niobium at the seal location would make possible a minimum and non-critical exposure length for the sealing frit within the electrode tubes.

To form a reliable sealing of the electrical feedthrough member into a polycrystalline alumina discharge tube, the electrical feedthrough member, the electrode sleeve and the sealing compound need to have similar thermal expansion coefficient to reduce stress at the sealing area during the arc tube sealing process and during the arc tube operation. The use of a ceramic sleeve to replace the molybdenum coil will result in significantly lower thermal stress thereabout over temperature changes as both the ceramic sleeve and the electrode sleeve are the same material. Also, the proposed electrode arrangement can have much tighter tolerances with much less empty space inside the electrode sleeve to eliminate the requirement for large amounts of metal halide to fill the space. This reduction of metal halide fill will make the correlated color temperature more stable during operation and will reduce the speed of chemical reaction between metal halide fill with polycrystalline alumina. Other advantage of using a ceramic sleeve to replace molybdenum coil is that at temperature higher than 500° C. the thermal conductivity of the ceramic (e.g., alumina) is ten times lower than that of the molybdenum metal so the heat loss of the tungsten electrode through the electrode sleeve tube will be significantly reduced. Another advantage of using a ceramic sleeve to replace molybdenum coil on the electrode is that molybdenum material reacts with iodine or bromine at certain conditions in an arc tube.

FIG. 2 illustrates an exemplary embodiment of an electrode arrangement according to the present disclosure. In this embodiment, the electrical feedthrough member 16 employs a three piece construction: a cylindrical outer rod 26A, a cylindrical middle rod 36A, and a cylindrical inner rod 31A. The middle rod 36A is positioned with one end outside of the electrode sleeve 14 and the opposed end residing in the passageway of the electrode sleeve 14. Although the middle rod 36A is preferably made of a cermet material, other materials having thermal expansion coefficients similar to the material of the electrode sleeve are also completed by this disclosure.

The outer rod 26A is joined concentrically (e.g., by a welded joint) to the end of middle rod 36A outside of the electrode sleeve; whereas the inner rod 31A is joined concentrically (e.g., by a welded joint) to the opposed end of the middle rod 36A. A niobium tube 23A may encircle the weld joint between the outer rod and the middle rod, thereby increasing the mechanical strength of the joint as well as serving a stop position for the electrode. In this embodiment, the outer rod 26A is made of niobium and the inner rod 31A is made of tungsten. However, it is again understood that metals having similar characteristics are within the scope of the present disclosure. Likewise, it is envisioned that rods having non-cylindrical shapes are within the scope of the present disclosure.

A ceramic sleeve 34A encircles a portion of the inner rod 31A within the passageway of the electrode sleeve 14. The outer diameter of the ceramic sleeve 34A is substantially equal to the inner diameter of the passageway. In one exemplary embodiment, the ceramic sleeve 34A abuts against the end of the middle rod 36A and extends longitudinally towards the inwardly facing end of the electrode sleeve 14, such that the end of the ceramic sleeve 34A is flush with the end of the electrode sleeve (not shown). In an alternative embodiment, a molybdenum or tungsten wire 33A is welded at the end of the ceramic sleeve 34A to fix its position on the inner rod. In this embodiment, the ceramic sleeve 34A extends nearly to the end of the electrode sleeve 14 as shown. In either case, the ceramic sleeve 34A occupies almost all of the space between the inner rod and the interior surface of the electrode sleeve so there is minimal space for metal halide salt to condense during lamp life. Exemplary ceramic materials may include alumina oxide, yttria oxide, aluminum nitride, as well as a mixture of alumina with molybdenum or tungsten metal.

A sealing fit 27A is disposed at the outwardly facing end of the electrode sleeve. Care must be taken to ensure that the melted sealing frits flow completely around and beyond the outer rod thereby forming a protective surface against the chemical reactions due to the halides. The frit flow length inside the electrode sleeve needs to be controlled very precisely. If the frit length is short, the outer niobium rod is exposed to chemical attack by the halides. If the frit length extends too far into the electrode sleeve, there is a large thermal mismatch between the frit and the inner rod which leads to cracks in the sealing frit or the polycrystalline alumina in that location. Therefore, the leading edge of the sealing frit should extend adjacent to the middle rod but stop before the ceramic sleeve and the inner rod. By spatially separating the sealing frit from the ceramic sleeve, thermal loss in the axial direction is reduced. It is understood that compounds other than frit are within the scope of the present disclosure.

Sealing process of the arc tube is carried out by heating the end of the ceramic sleeve with a frit ring at the joint location. The heating is applied in a sealing furnace with controlled filling gas environment. The sealing length of the frit material inside the ceramic sleeve is controlled by adjusting the location of the sheet metal heat shields applied to the ceramic sleeve inside the furnace. The sheet metal heat shields limit the portion of the ceramic sleeve being heated by the heating element of the furnace.

The description of the invention is merely exemplary in nature and, thus, variations that do not depart from the gist of the invention are intended to be within the scope of the invention. Such variations are not to be regarded as a departure from the spirit and scope of the invention. It should be understood that throughout the drawings, corresponding reference numerals indicate like or corresponding parts and features.

What is claimed is:

1. An arc tube for use in a high intensity discharge lamp, comprising:

an elongated outer envelope defining two opposed ends and an inner cavity therebetween;

an electrode sleeve protruding outwardly from each end of the outer envelope, each electrode sleeve having a passageway from outside of the arc tube into the inner cavity;

an electrical feedthrough member inserted into the passageway of the electrode sleeve, the feedthrough member including an inner rod that extends into the inner cavity of the arc tube and a ceramic sleeve encircling a portion of the inner rod disposed within the passageway, wherein the electrical feedthrough member further includes a middle rod having one end outside of the electrode sleeve and an opposed distal end joined to the inner rod at a point inside of the electrode sleeve, and an outer rod joined to the middle rod at the end outside of the electrode sleeve; and a sealing compound disposed at an outwardly facing end of the passageway for sealing the feedthrough member to the electrode sleeve, the sealing compound extending into the passageway of the electrode sleeve but spatially separated from the ceramic sleeve.

2. The arc tube of claim 1 wherein the sealing compound is a frit material.

3. The arc tube of claim 1 wherein the middle rod is made of a cermet material.

4. The arc tube of claim 1 further comprises a tube encircling the join between the outer rod and the middle rod.

5. The arc tube of claim 1 wherein the ceramic sleeve is made of a material selected from the group consisting of alumina, yttria and aluminum nitride.

6. The arc tube of claim 1 wherein the ceramic sleeve is made of a mixture of alumina and either molybdenum metal or tungsten metal.

7. The arc tube of claim 1 wherein the passageway of the electrode sleeve having a cylindrical shape such that an outer diameter of the ceramic sleeve is substantially equal to a diameter of the passageway.

8. The arc tube of claim 1 wherein the ceramic sleeve extends axially to an inwardly facing end of the passageway.

9. An arc tube for use in a high intensity discharge lamp, comprising:

an elongated outer envelope defining two opposed ends and a cavity therebetween;

a cylindrical electrode sleeve extending longitudinally from each end of the outer envelope, each electrode sleeve providing a passageway along a longitudinal axis of the sleeve;

an electrode inserted into the passageway of each electrode sleeve, the electrode being comprised of a metal outer rod, a middle rod and a metal inner rod, wherein the middle rod is made of a cermet material and has one end extending outside of the electrode sleeve and an opposed end disposed inside of the electrode sleeve, such that the outer rod is axially aligned to the end of the middle rod outside of the electrode sleeve and the inner rod is axially aligned to the opposed end of the middle rod;

a ceramic sleeve encircling a portion of the inner rod disposed within the passageway, the ceramic sleeve having an outer diameter that is substantially equal to a diameter of the passageway and extends longitudinally to an inwardly facing end of the passageway; and a sealing compound disposed at an outwardly facing end of the passageway for sealing the electrode to the electrode sleeve, the sealing compound extending into the passageway of the electrode sleeve but spatially separated from the ceramic sleeve.

10. An arc tube for use in a high intensity discharge lamp, comprising:

an elongated outer envelope defining two opposed ends and an inner cavity therebetween;

a cylindrical electrode sleeve extending longitudinally from each end of the outer envelope, each electrode sleeve providing a cylindrical passageway along a longitudinal axis of the sleeve;

an electrode inserted into the passageway of each electrode sleeve, the electrode being comprised of a cylindrical middle rod having one end extending outside of the electrode sleeve and an opposed end disposed inside of the electrode sleeve, a cylindrical outer rod joined concentrically to the middle rod at the end outside of the electrode sleeve, and a cylindrical inner rod joined concentrically to the middle rod at the opposed end inside of the electrode sleeve;

a ceramic sleeve encircling a portion of the inner rod disposed within the passageway and having an outer diameter that is substantially equal to a diameter of the passageway; and a sealing compound disposed at an outwardly facing end of the passageway for sealing the electrode to the electrode sleeve, the sealing compound extending into the passageway only adjacent to the middle rod.

11. The arc tube of claim 10 wherein the middle rod is made of a cermet material.

12. The arc tube of claim 10 further comprises a tube encircling the joint between the outer rod and the middle rod.

13. The arc tube of claim 10 wherein the ceramic sleeve extends axially to an inwardly facing end of the passageway.

14. The arc tube of claim 10 wherein the sealing compound is a frit material.

* * * * *